US005584645A

United States Patent [19]

Kaspar

[11] Patent Number: 5,584,645

[45] Date of Patent: Dec. 17, 1996

[54] TELESCOPIC BOOM WITH A MULTISTAGE, LOCKABLE HYDRAULIC CYLINDER PROTECTED AGAINST BUCKLING

[75] Inventor: Ernst Kaspar, Munderkingen, Germany

[73] Assignee: EC Engineering & Consulting Spezialmachinen GmbH, Ulm, Germany

[21] Appl. No.: 286,995

[22] Filed: Aug. 8, 1994

[30] Foreign Application Priority Data

Dec. 8, 1993 [DE] Germany ..... 9318847 U

[51] Int. Cl.[6] ..... B66C 23/00

[52] U.S. Cl. ..... 414/728; 91/153; 91/192; 91/193

[58] Field of Search ..... 414/718, 722, 414/728; 91/153, 156, 192, 193; 52/115, 118; 212/349, 350

[56] References Cited

U.S. PATENT DOCUMENTS

| | | | |
|---|---|---|---|
| 3,353,686 | 11/1967 | Cowan | 212/55 |
| 3,792,555 | 2/1974 | Sung | 52/115 |
| 3,836,011 | 9/1974 | Sakamoto et al. | 212/144 |
| 3,837,502 | 9/1974 | Hornagold | 212/55 |
| 4,358,915 | 11/1982 | Pantalone | 52/115 |
| 4,408,424 | 10/1983 | Sutter | 52/115 |

FOREIGN PATENT DOCUMENTS

| | | |
|---|---|---|
| 0217294 | 4/1987 | European Pat. Off. . |
| 1122682 | 1/1962 | Germany . |
| 1240743 | 5/1967 | Germany . |
| 1756141 | 8/1970 | Germany . |
| 2900015 | 7/1980 | Germany . |
| 3021633 | 12/1981 | Germany . |
| 3835945 | 2/1990 | Germany . |
| 1191395 | 5/1970 | United Kingdom . |
| 1211036 | 11/1970 | United Kingdom . |
| 2206929 | 1/1989 | United Kingdom . |

*Primary Examiner*—Donald W. Underwood
*Attorney, Agent, or Firm*—Rothwell, Figg, Ernst & Kurz

[57] ABSTRACT

A telescopic boom with a multistage, lockable hydraulic cylinder is provided with a protection against lateral buckling of the hydraulic cylinder, said hydraulic cylinder being supported by the more rigid boom members (telemembers). For this purpose, a multipart supporting device is provided, one part of said supporting device being secured to at least one unit of the multistage hydraulic cylinder and the other part thereof being secured to the inner wall of the at least one telemember. The two parts of the supporting device are continuously in engagement with one another so that the desired protection against buckling of the hydraulic cylinder will be guaranteed at all positions of the boom. Furthermore, suitable measures guarantee that, starting with the cylinder unit having the largest cross-section, it is always the cylinder unit having the next smaller cross-section which, in an orderly sequence, is first fully extended, the reverse order being observed during the retraction process. A particular advantage of the present invention is to be seen in the fact that hydraulic fluid can in each case only be supplied to the cylinder chamber of a cylinder unit which has already reached its fully extended position, since a check valve is still closed in all the subsequent cylinder units so that these cylinder units cannot be extended for the time being. This check valve will only open when the cylinder unit occupies its fully extended position.

21 Claims, 9 Drawing Sheets

Figure 1:
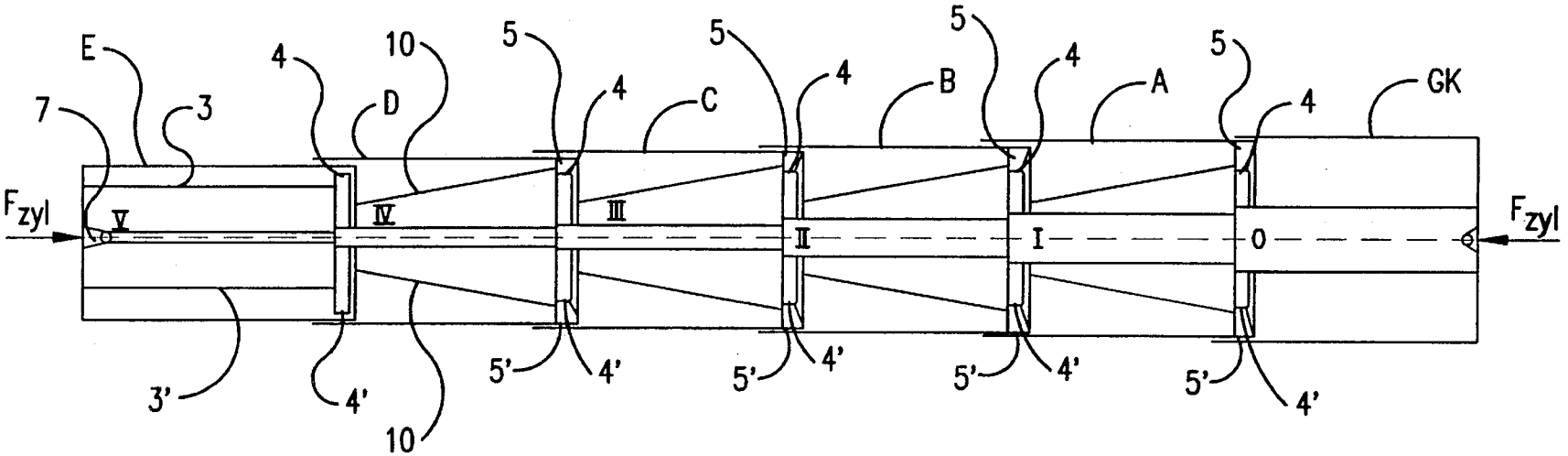

TELESCOPIC BOOM WITH A MULTISTAGE, LOCKABLE HYDRAULIC CYLINDER PROTECTED AGAINST BUCKLING

For the purpose of extending and retracting telescopic booms, e.g. booms of cranes and excavators, telescopic, i.e. multistage, hydraulic cylinders are frequently used. Each subsection of the telescopic boom, i.e. each so-called telemember, has normally associated therewith one unit of the multistage telescopic hydraulic cylinder. When the machine in question is in operation, the hydraulic cylinder is acted upon by bending forces, said bending forces increasing in proportion to the increase in the length of the hydraulic cylinder and resulting from the unloaded weight of the hydraulic cylinder as well as from the loads to be lifted. These bending forces may cause buckling of the hydraulic cylinder.

Up to now, attempts have been made to prevent such buckling by providing the cylinder walls with adequately strong dimensions. However, this strong dimensioning of the hydraulic cylinder walls results in an increase of the unloaded weight of the hydraulic cylinder, and this has the effect that the maximum load which can be lifted is reduced accordingly.

When known, conventional multistage hydraulic cylinders are used, it is not guaranteed that one cylinder unit after the other will fully be extended and, subsequently, retracted. Due to different frictional conditions between the individual hydraulic cylinder units, individual cylinder units may be left out or extended only partially.

Hence, it is the object of the present invention to construct a telescopic boom with a multistage hydraulic cylinder in such a way that, starting with the cylinder unit having the largest cross-section, it is always the hydraulic cylinder unit having the next smaller cross-section which, in an orderly sequence, is first fully extended, the reverse order being observed during the retraction process in a corresponding manner. In addition, it should be guaranteed that there is no risk of buckling of the hydraulic cylinder under any operating conditions.

This object is achieved by the invention disclosed in the main claim.

The advantage which can be achieved with the aid of the present invention essentially is to be seen in the fact that hydraulic fluid can in each case only be supplied to the cylinder chamber of the hydraulic cylinder which has already reached its fully extended position, since the check valves are closed in all the subsequent hydraulic cylinder units so that these cylinder units cannot be extended for the time being. In view of the fact that the check valve will only open when the plunger-type cylinder occupies its fully extended position, it is guaranteed that none of the plunger-type cylinders will be left out or extended only partially.

In addition, as soon as the cylinder unit has fully been extended and as soon as the check valve has been opened for the purpose of filling the cylinder chamber following the cylinder unit in question, each cylinder unit will be locked mechanically in the extended position so that subsequent unintentional sliding back will be excluded as well. One preferred embodiment is provided with the features that the mutual locking of the hydraulic cylinder units is effected by preventing the hydraulic fluid from flowing back by means of the non-return valve.

The above-mentioned locking and arresting means guarantee that, in comparison with the sequence of steps carried out for extending the hydraulic cylinder units, the sequence of steps required for retracting the hydraulic cylinder units is carried out exactly reversed in order.

Furthermore, the technical progress which can be achieved by means of the present invention results from the fact that measures have been taken with the aid of which the hydraulic cylinder is supported throughout its whole length or throughout selected subsections thereof by the telemembers of the boom which are constructed as buckle-proof members from the very beginning. A particular advantage results from the fact that, thanks to the present invention, protection against buckling of the hydraulic cylinder exists not only in the final stages of the boom extension process but also in all intermediate stages and even during the transition from one stage of the boom extension process to the next.

An additional advantage of the present invention results from the fact that the individual hydraulic cylinder units are prevented from rotating relative to one another, since the supporting means according to the present invention guarantee that a rotational displacement of individual hydraulic cylinder units relative to one another cannot occur.

Figure 2:
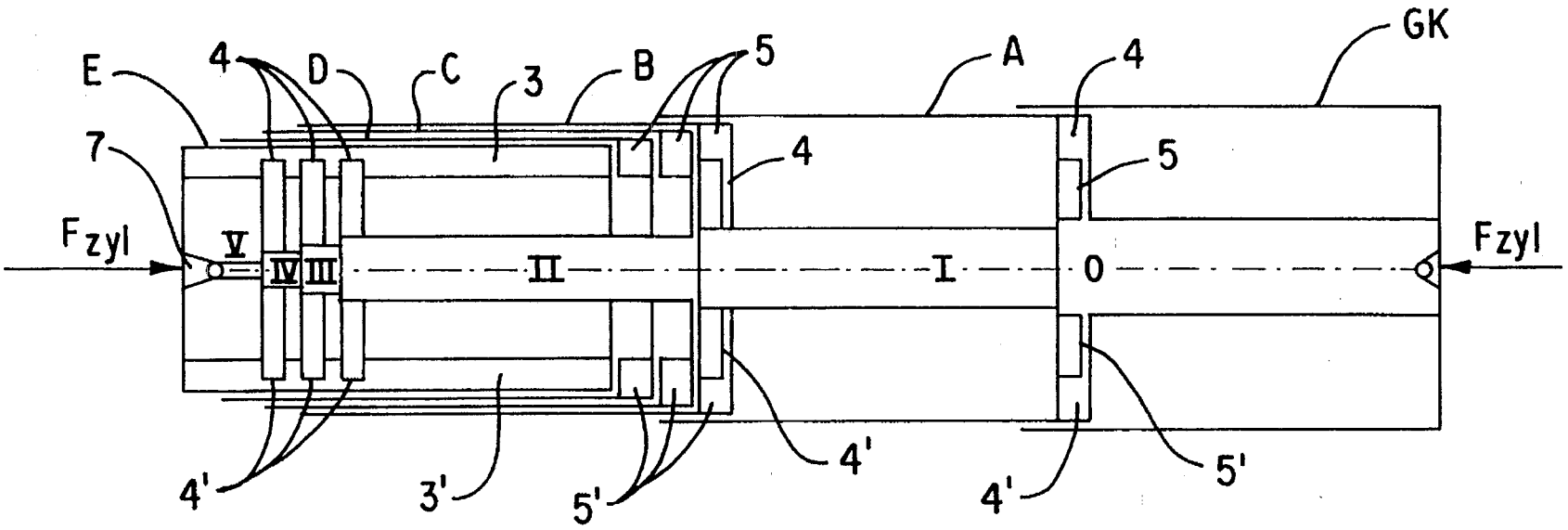
Figure 3:
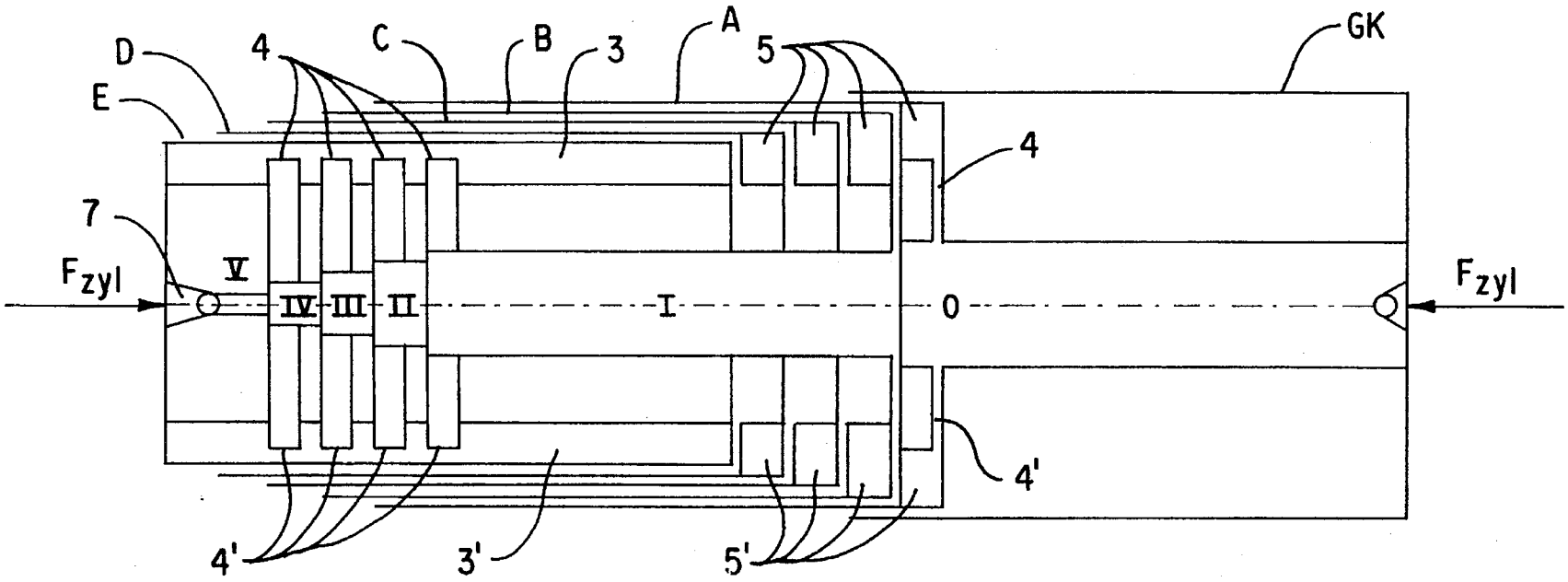
Figure 4:
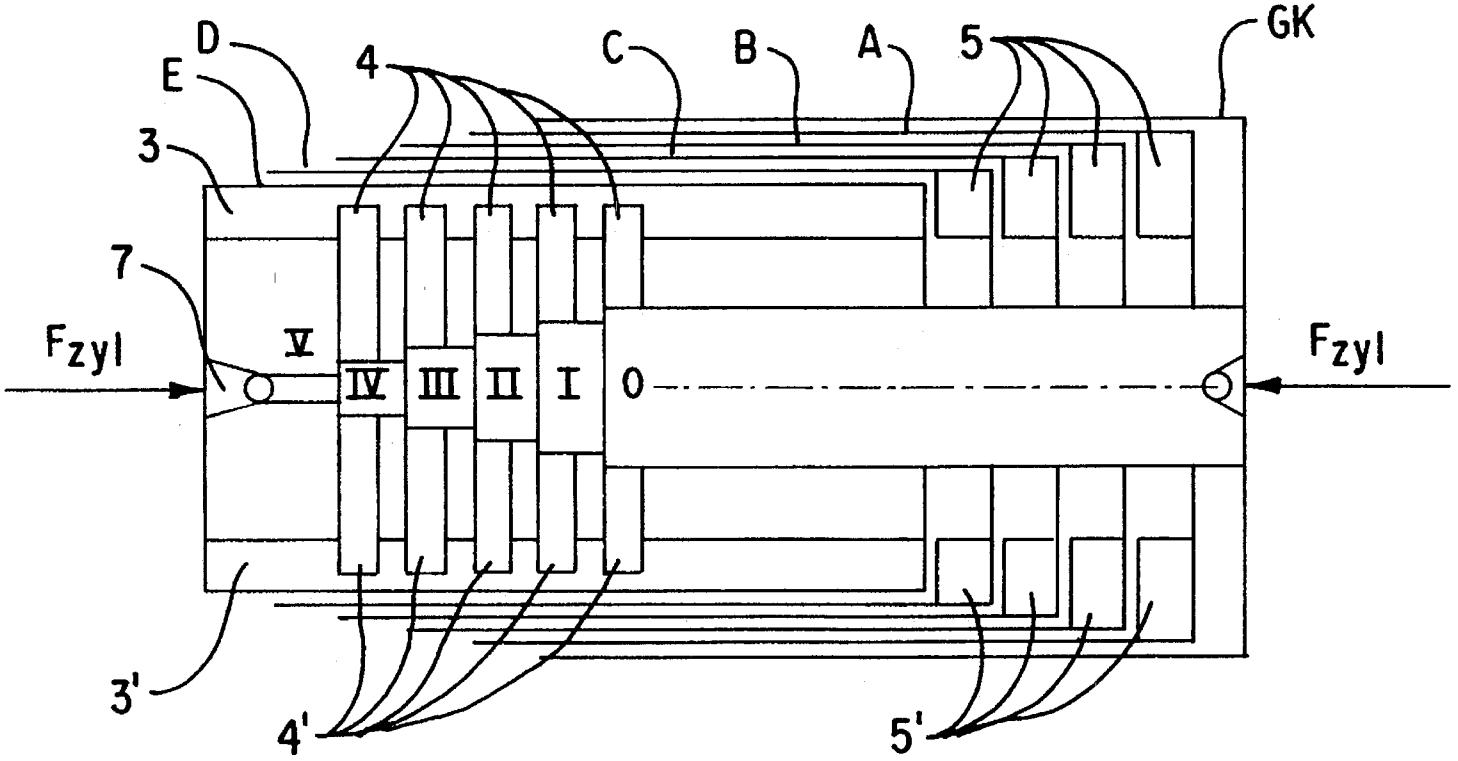
Figure 5:
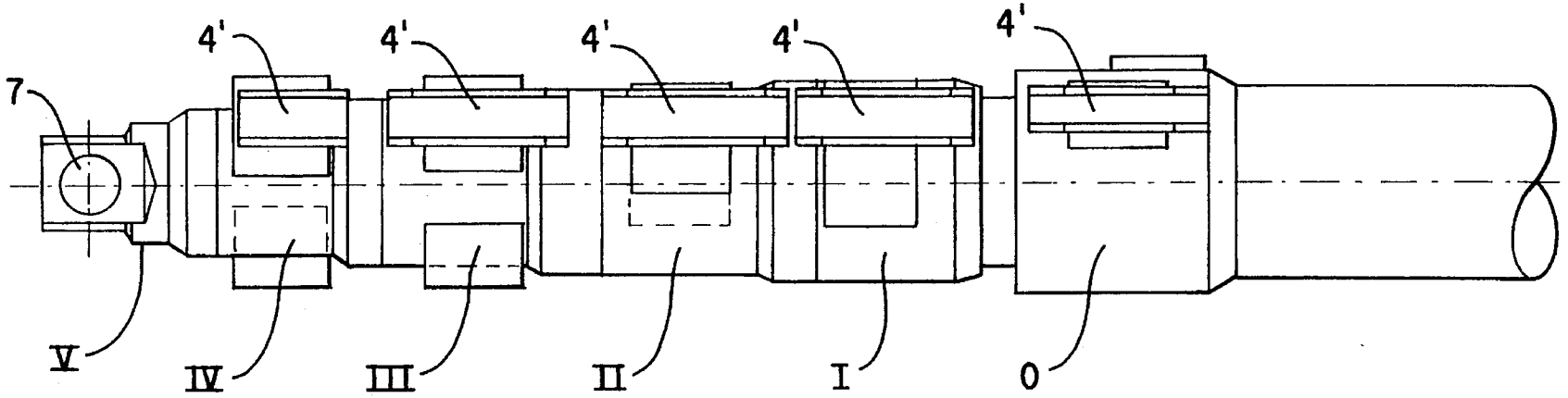
Figure 6:
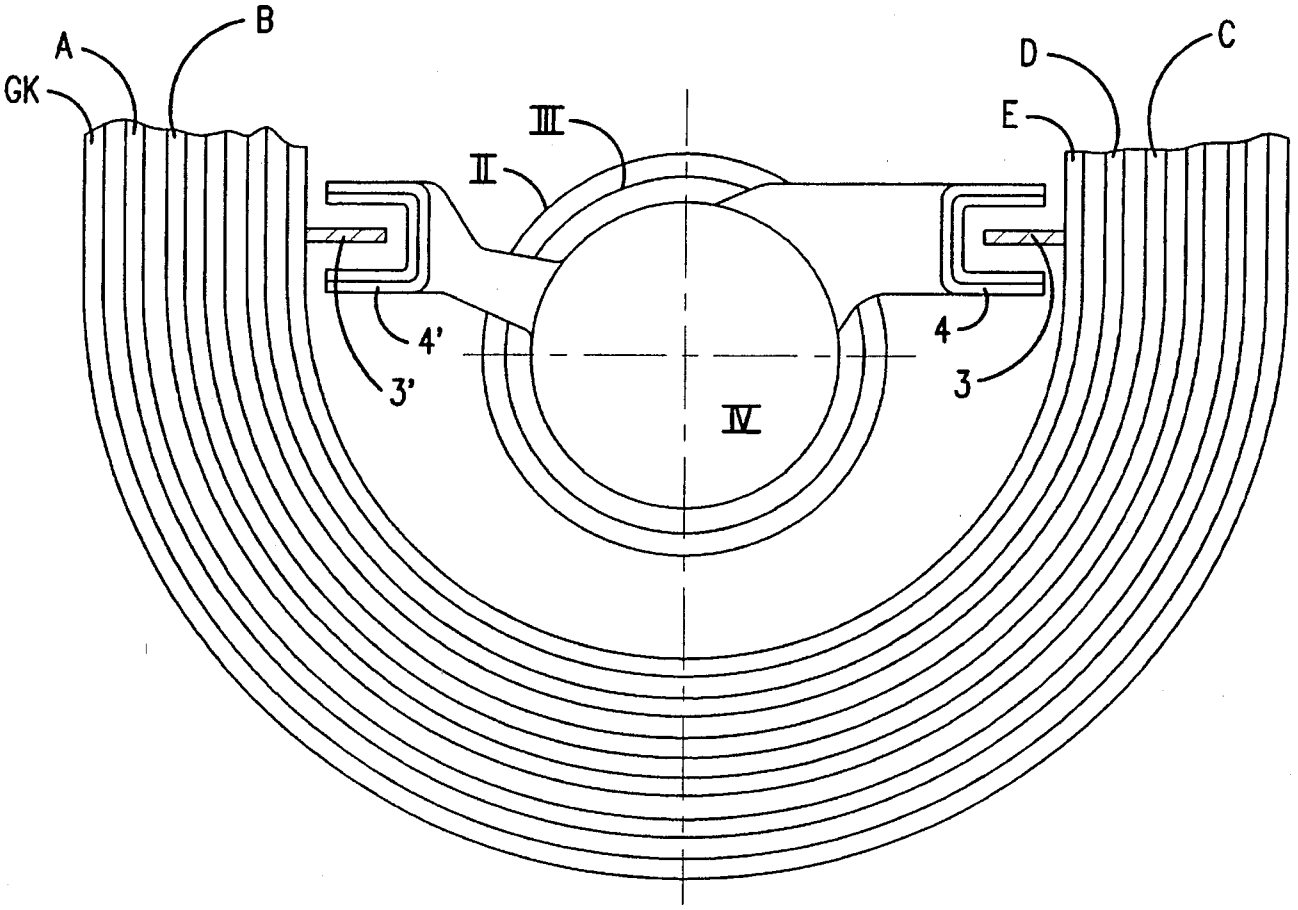
Figure 7:
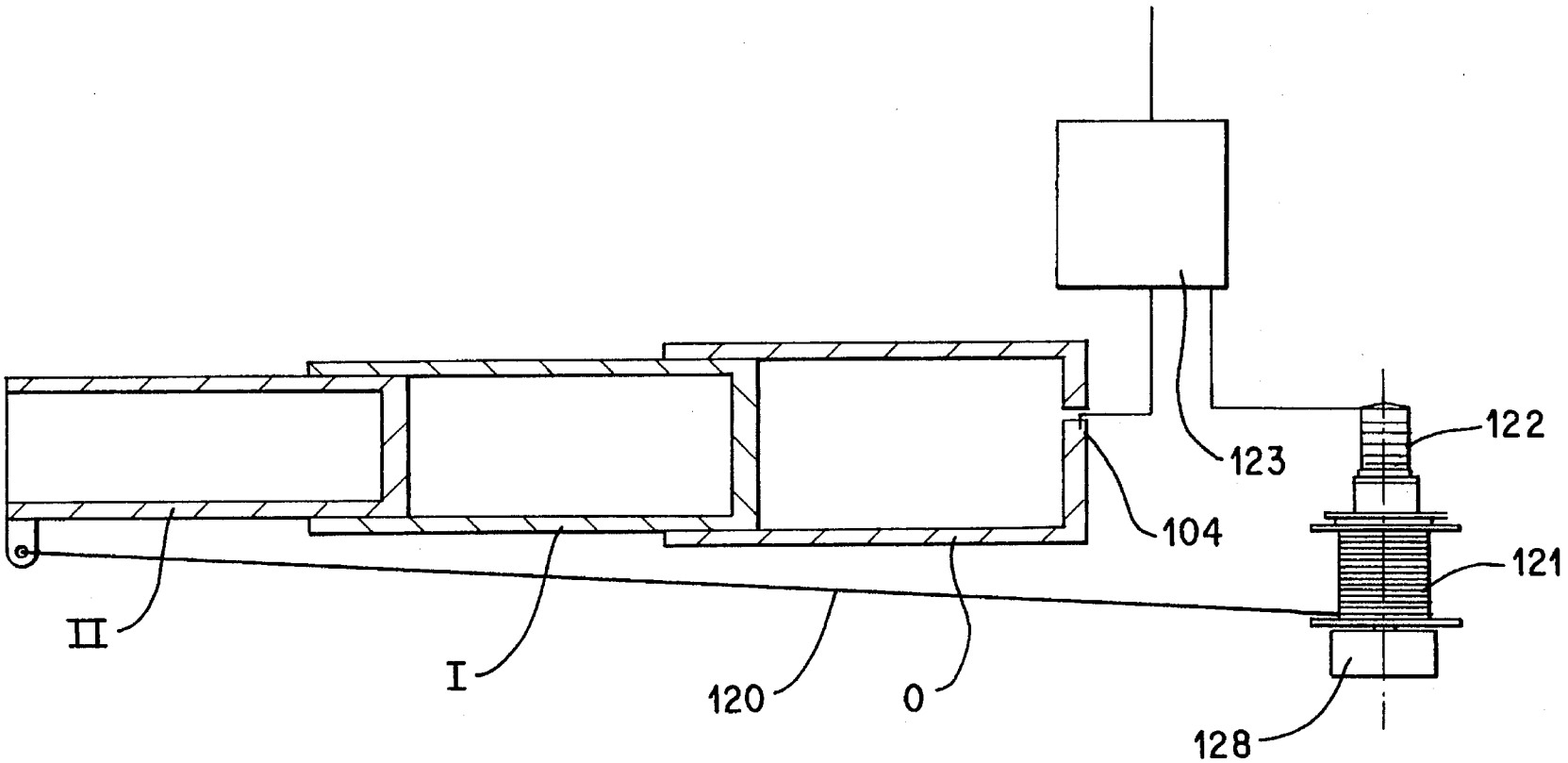
Figure 8:
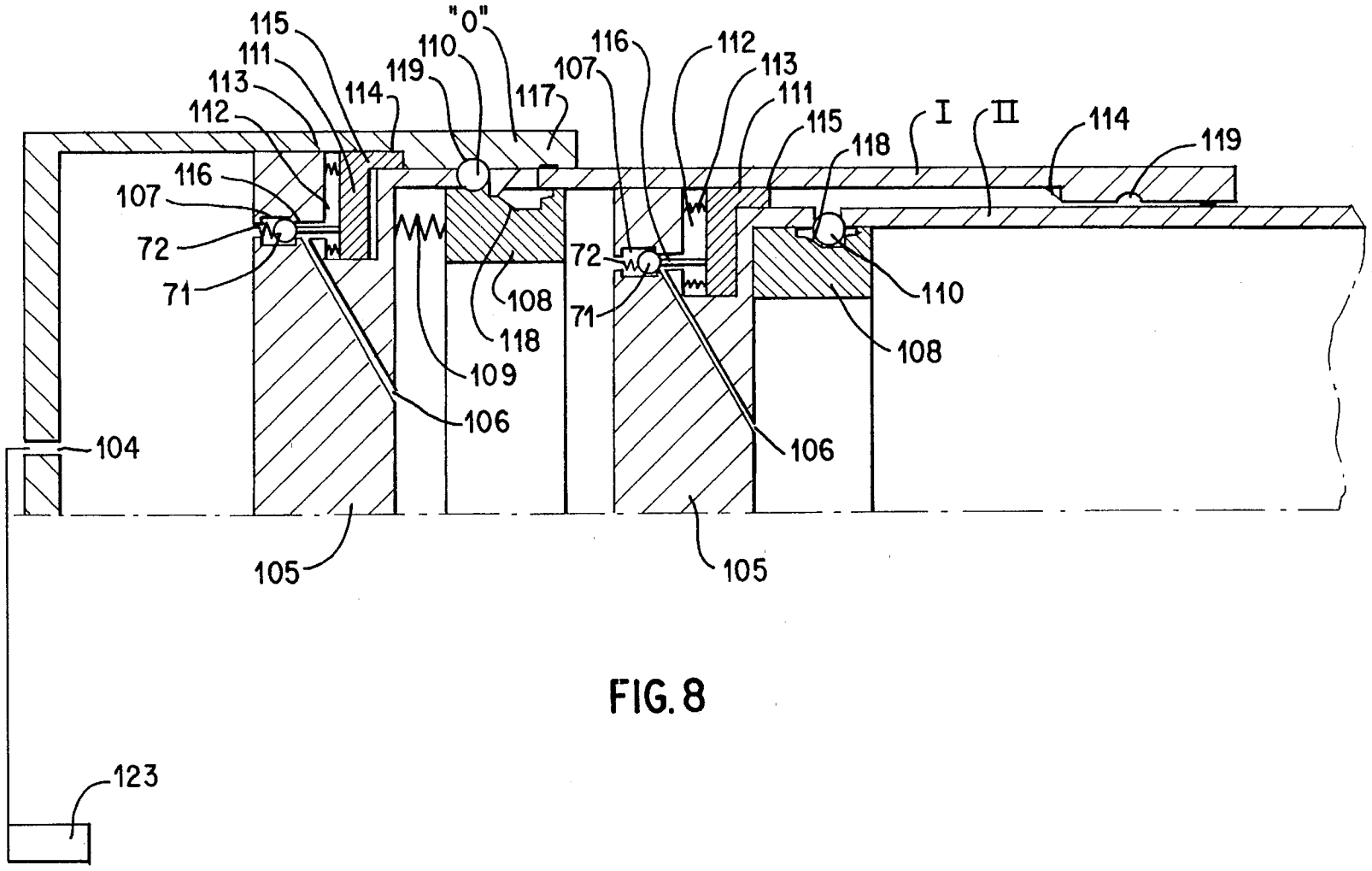

In the following, the present invention will be described in detail on the basis of embodiments and with reference to the drawing, in which:

FIG. 1 shows a schematic representation of a boom comprising five telemembers and a five-stage hydraulic cylinder, in the fully extended condition, FIG. 2 shows the boom according to FIG. 1, in which, however, only two telemembers and only two units of the hydraulic cylinder are extended, FIG. 3 shows the boom according to FIG. 1 and 2, in which, however, only one telemember and only one unit of the hydraulic cylinder are extended, FIG. 4 shows the boom according to FIG. 1 to 3 in the fully retracted condition, FIG. 5 shows a view of the hydraulic cylinder in the fully retracted condition, FIG. 6 shows a representation of the way in which the components of the buckling protection device cooperate, FIG. 7 shows a schematic representation of a multistage hydraulic cylinder, FIG. 8 shows a fragmentary longitudinal section of the multistage hydraulic cylinder according to FIG. 7, FIG. 9 shows, again in the form of a fragmentary longitudinal section, a second embodiment of the hydraulic cylinder according to the present invention.

According to FIG. 1, the telescopic boom shown comprises a non-telescopic basic member GK as well as five telescopic members A to E, which will be referred to as telemembers hereinbelow. From the basic member GK up to telemember E, which is extended furthest and which has the smallest dimensions as far as the diameter is concerned, the diameters and the base areas of the telemembers decrease in a manner known per se.

For extending the telemembers A to E from the basic member GK and for retracting them into said basic member GK, a hydraulic cylinder is provided, which comprises five telescopic cylinder units I to V in addition to a basic unit "0" arranged in the basic member GK of the boom. Cylinder unit I, which follows the basic unit "0", serves to extend and retract telemember A; cylinder unit II, which follows said cylinder unit I, serves to extend and retract telemember B; cylinder unit III, which follows said cylinder unit II, serves to extend and retract telemember C; cylinder unit IV, which follows said cylinder unit III, serves to extend and retract telemember D, and the final unit V, which follows said cylinder unit IV, serves to extend and retract the outermost telemember E, i.e. the telemember which is adapted to be extended furthest.

As has only been outlined in FIG. 1, the upper end portions of cylinder units I to IV are connected to the upper end portions of two tie rods 10 whose lower ends are connected to the base areas of the respective telemembers A to D associated with said cylinder units in a motion-transmitting manner. Cylinder unit I is thus connected in a motion-transmitting manner to telemember A by means of such tie rods, cylinder unit II is connected in a motion-transmitting manner to telemember B by means of its tie rods, cylinder unit III is connected in a motion-transmitting manner to telemember C by means of its tie rods, and cylinder unit IV is connected in a motion-transmitting manner to telemember D by means of tie rods. Only cylinder unit V, which is extended furthest, is connected in a motion-transmitting manner to the upper telemember E without any tie rods being used. For this purpose, tie bolts, which are not shown in the figures, are provided, said tie bolts extending through holes 7, which are provided in the upper end portion of cylinder unit V, and being connected to telemember E in a motion-transmitting manner.

It is specially emphasized that said tie rods 10 may just as well be constructed as traction cables or the like. It is only necessary that the motion of each telescopic hydraulic cylinder unit is transmitted to the associated telemember simultaneously and uniformly.

The diameters and the cross-sectional areas of the boom members decrease continuously from the basic member GK to the smallest telemember E, as can be seen from FIG. 1 to 4. Also the diameters of the cylinder units decrease from the basic unit "0" to the thinnest cylinder unit V, which is adapted to be extended furthest.

Telemember E, which is adapted to be extended furthest, has provided therein two support rails 3, 3' extending along the inner wall thereof and parallel to the longitudinal axis of the hydraulic cylinder, said support rails 3, 3' having sufficiently solid dimensions and being welded to the inner wall of the telemember, as can be seen from FIG. 1 and 6.

Supporting claws 4, 4', which are in engagement with said support rails 3, 3', are provided in the area of the upper end of cylinder unit IV, said supporting claws 4, 4' being arranged in opposed relationship with one another and welded to the outer wall of cylinder unit IV, as can be seen in FIG. 6. The thinnest cylinder unit V is not provided with any supporting claws and is not shown in FIG. 6.

The length of the support rails 3, 3' corresponds approximately to the length of the associated telemember E. From FIG. 4 as well as from the statements following hereinbelow, it will be evident that the length of the support rails 3, 3' should be dimensioned such that, in the retracted condition (FIG. 4), all supporting claws 4, 4' are in engagement with the rails 3, 3'. As can be seen from FIG. 1 to 4, telemembers A, B, C and D only have short support rail pieces 5, 5' instead of the long support rails 3, 3' said support rail pieces 5, 5' extending, however, in the same planes as the support rails 3, 3' of the outermost telemember E, i.e. in alignment therewith.

Also said short support rail pieces 5, 5' are fixedly connected to the inner walls of the associated telemembers A to D and they are preferably provided in the lower, i.e. in the base area of the above-mentioned telemembers. The long rail 3 is in alignment with the short rail pieces 5 in the extended condition, just as the long rail 3' is in alignment with the short rails pieces 5' in the extended condition. The rails 3, 3' and the short rail pieces 5, 5' preferably have bevelled ends.

In the fully extended condition of the boom according to FIG. 1, the two supporting claws 4, 4' of the basic unit "0" of the hydraulic cylinder are in engagement with the two short support rail pieces 5, 5' arranged in telemember A, whereas the supporting claws 4, 4' of cylinder unit I are in engagement with the short support rail pieces 5, 5' of telemember B. In the fully extended condition, also the supporting claws 4, 4' provided on cylinder unit II are in engagement with the short support rail pieces 5, 5' of telemember C and the supporting claws 4, 4' provided on cylinder unit III are in engagement with the short support rail pieces 5, 5' provided in telemember D. As has already been described, the long support rails 3, 3' provided in telemember E, which is extended furthest, are permanently in engagement with the supporting claws 4, 4' provided on cylinder unit IV.

As can be seen from FIG. 6, the supporting claws 4, 4' enclose the support rails 3, 3' and the support rail pieces 5, 5', which are in alignment with these rails, from three sides, since each claw end has the shape of a C-section which is open towards the rails 3, 3' and towards the support rail pieces 5, 5'.

Due to the fact that the claws 4, 4' are in engagement with the rails 3, 3' and the short pieces 5, 5', respectively, the hydraulic cylinder can, as demonstrated in FIG. 6 where hydraulic cylinder unit IV is shown by way of example, only bend until one of the supporting claws 4, 4' comes into contact with one of the support rails 3, 3' or one of the support rail pieces 5, 5', either on the left- or on the right-hand side, at the top or at the bottom (FIG. 6). Horizontal or vertical buckling of the hydraulic cylinder is impossible because all cylinder units or at least one cylinder unit rest(s) on the associated telemembers by means of the claw and rail construction described hereinbefore, said telemembers having, in view of the loads to be hoisted, much more rigid dimensions from the very beginning.

The inside width between the opposing support rails 3, 3' of the outermost telemember E corresponds to the inside width between the opposing support rail pieces 5, 5' of telemembers A to D, as can be seen in FIG. 1 to 4.

In the following, it will be described how the telemembers and the cylinder units are moved from their fully retracted starting position according to FIG. 4 via partly extended intermediate positions to their fully extended position according to FIG. 1:

At the starting position according to FIG. 4, all telemembers A to E are accommodated in the basic member GK of the boom according to their various sizes, and the cylinder units I to V are accommodated in the basic unit "0" of the cylinder according to their various sizes.

At this position, the telemember bases (bottom sides) through which the cylinder units extend face one another and are spaced apart essentially only in accordance with the dimensions of the support rail pieces 5, 5' in a direction parallel to the longitudinal axis of the hydraulic cylinder. The supporting claws 4, 4' of the cylinder basic member GK as well as of all cylinder units A to E are in engagement with the two support rails 3, 3' of the innermost telemember E at the starting position according to FIG. 4. In order to permit this engagement of all supporting claws with the rails 3, 3', said rails 3, 3' must have clearly larger dimensions in the direction of the longitudinal axis of the cylinder, i.e. they must be longer than the short support rail pieces 5, 5'—a fact which has already been mentioned.

When cylinder unit I has applied thereto hydraulic pressure, said cylinder unit will move out of the basic unit "0". In view of the fact that, by means of the tie rods 10 (which are not shown in FIG. 4) or with the aid of other suitable connection means, said cylinder unit I is fastened to telemember A—more exactly to the base side of said telemember A—the cylinder force $F_{zyl}$ will be transmitted to telemember A so that this telemember will move upwards together with cylinder unit I simultaneously and uniformly therewith. As has already been mentioned, telemember A, however, still accommodates telemembers B to E at this time so that these telemembers B to E will move upwards together with telemember A, just as cylinder units I to IV which will take part in this movement. During the sequence of movements taking place between the condition according to FIG. 4 and the condition according to FIG. 3, the support rails 3, 3' of the innermost telemember E will move upwards, whereas the supporting claws 4, 4', which are associated with the basic unit "0" of the cylinder, will remain stationary. Hence, the rails 3, 3' of the innermost telemember E will be moved relative to the supporting claws 4, 4', of the basic member GK of the cylinder. In the course of this relative movement, the lower ends of the support rails 3, 3' will come out of engagement with the supporting claws 4, 4' associated with the basic unit "0" of the hydraulic cylinder. Subsequently, while the upward movement of cylinder unit I continues, these supporting claws of the basic unit "0" will come into and out of engagement first with the support rail pieces 5, 5' of telemember D, then with those of telemember C and subsequently with those of telemember B, said support rail pieces 5, 5' being in alignment with said support rails 3, 3'. When cylinder unit I has fully been extended (FIG. 3), the supporting claws 4, 4' of the basic unit "0" of the cylinder are in engagement with the support rail pieces 5, 5' of telemember A. In order to facilitate the above-described movement of the support rails or support rail pieces through the supporting claws, the end portions of said rails or rail pieces are bevelled, as has already been described hereinbefore.

The length, i.e. the dimensions of the supporting claws 4, 4' parallel to the longitudinal axis of the cylinder, is chosen (cf. FIG. 5) such that spaces between neighbouring ends of support rails and support rail pieces, respectively, are bridged so that "incorrect threading" cannot occur, i.e. so that any unintentional disengagement of a supporting claw from a support rail or a support rail piece is prevented.

It follows that the aimed-at protection against buckling of the hydraulic cylinder is guaranteed not only at the end position, e.g. according to FIG. 1, but also at all intermediate positions between the positions according to FIG. 1 up to the position according to FIG. 4 as well as during the extension movement.

In the next step, i.e. during extension of the boom from the position shown in FIG. 3 to the position according to FIG. 2, cylinder unit II is extended by means of pressure applied thereto. Also this unit is connected to the associated telemember B through tie rods 10 or the like, which are not shown. It follows that, due to the upward movement of telemember B as well as of telemembers C, D and E, which are accommodated in telemember B, a relative movement will again take place between the supporting claws 4, 4' associated with cylinder unit I and the support rails 3, 3' and the support rail pieces 5, 5' of telemembers D and C. When the cylinder stroke has been finished (cylinder II), the supporting claws 4, 4' associated with this unit II will be in engagement with the rail pieces 5, 5' of telemember B, as can be seen in FIG. 2.

Telemembers C, D and E will be extended in an analogous manner by a successive extension of cylinder units III, IV and V until the boom has reached a fully extended position according to FIG. 1. In this respect, attention has to be paid to the fact that the supporting claws 4, 4' of cylinder unit IV always remain in engagement with the support rails 3, 3' of the innermost telemember E at all extension positions from FIG. 4 to FIG. 1.

When the boom is retracted from the position according to FIG. 1 to the position according to FIG. 4, the above-mentioned steps are carried out in reverse order; cylinder unit V, which has the smallest diameter and which has telemember E fastened thereto, is retracted first, whereupon cylinder unit IV having telemember D associated therewith is retracted, and then, in succession, cylinder unit III with the associated telemember C, cylinder unit II with the associated telemember B and, finally, cylinder unit I with the associated telemember A.

It goes without saying that the gripping claws and the rails or rail pieces can be interchanged in accordance with the present invention; in this case, the individual cylinder units will have secured thereto rails or short rail pieces, whereas the inner walls of the telemembers will have secured thereto supporting claws which are in engagement with said rails or rail pieces so as to prevent buckling of the hydraulic cylinder.

The embodiment of the hydraulic cylinder according to the present invention will be described hereinbelow on the basis of FIG. 7, 8 and 9.

FIG. 7 shows the basic unit "0" associated with the basic member GK of the boom as well as cylinder units I and II associated with telemembers A and B.

The hydraulic cylinder units are adapted to be telescoped like a piston-cylinder arrangement by means of pressure applied thereto by a hydraulic fluid. The hydraulic fluid is supplied through an opening 104 provided in the stationary basic unit "0", said opening 104 being outlined only schematically.

Each of the longitudinally displaceable cylinder units, with the exception of the innermost cylinder unit, is closed by a piston head 105 at the end face constituting the rear end face when seen in the direction of extension. The piston head 105 has provided therein a transfer port 106 for the hydraulic medium, which extends between the two axial sides thereof and which is adapted to be closed by a check valve 107. This check valve 107 normally occupies its closed position and will only be opened when the cylinder units I, II are fully extended.

The embodiment according to FIG. 8 is additionally provided with a locking ring 108, which is arranged in the cylinder chamber of each of the telescopic cylinder units I, II and which is adapted to be axially displaced against the force of a spring 109 towards the piston head 105, said axial displacement being effected by means of the piston head 105 of the next cylinder unit II arranged in the cylinder chamber. The locking ring 108 actuates one or more locking elements 110 which will block the displaceability of this cylinder unit II relative to the surrounding cylinder unit I, when the locking ring 108 occupies the position at which it faces away from the piston head 105.

Figure 9:
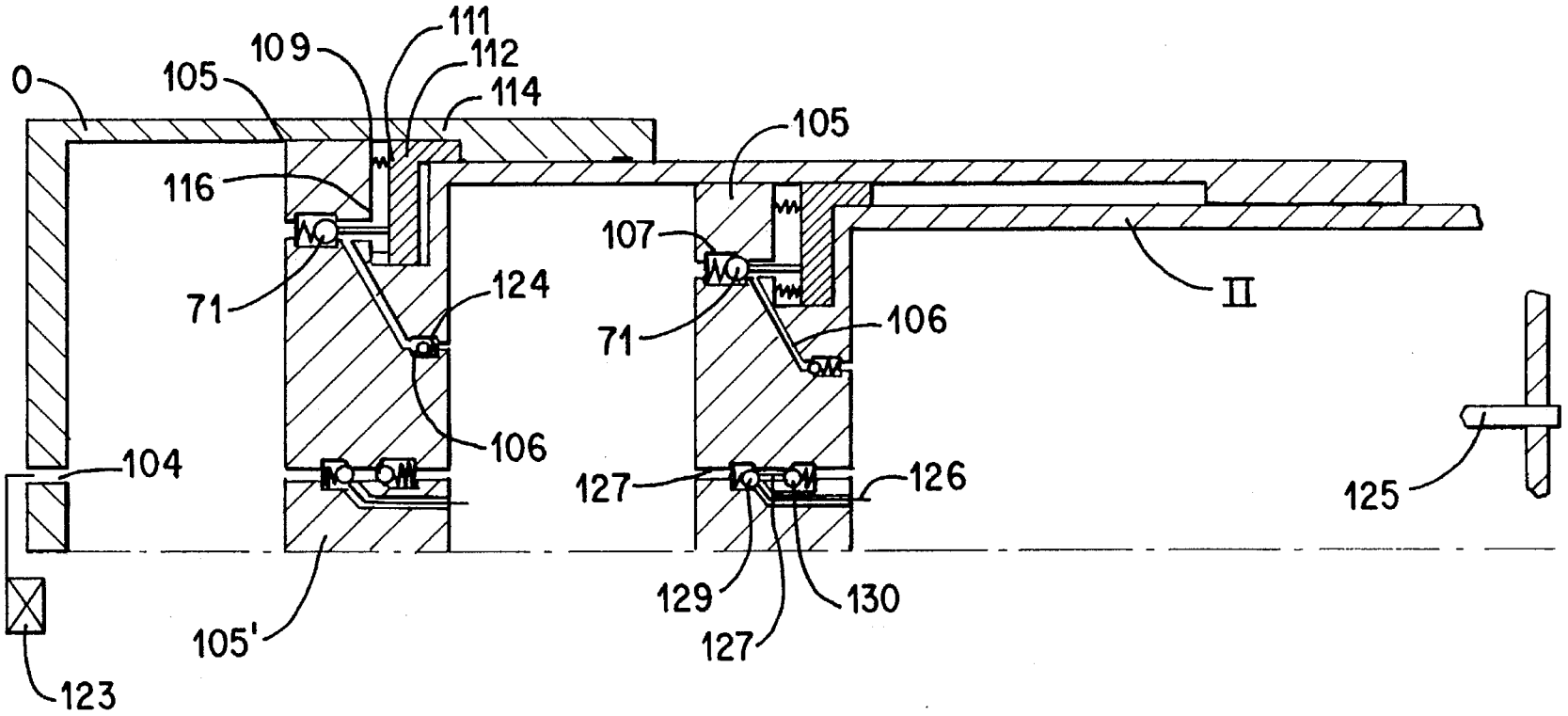

Other than the above-mentioned embodiment, the embodiment according to FIG. 9 includes a non-return valve 124 in the transfer port 106 for locking the individual cylinder units I and II; the hydraulic medium is prevented from flowing back by means of this non-return valve 124. For retracting the individual cylinder units I, II, the hydraulic medium contained therein is returned to the hydraulic means 123 via a recirculating line 125, which is adapted to be closed, at the smallest-diameter cylinder II. During the extension as well as during the retraction movement, the hydraulic medium always flows in the direction of the largest-diameter basic unit "0" of the cylinder to the smallest-diameter unit II. In order to permit the individual cylinder units 0, I, II to be emptied in the predetermined sequence, an actuator 126 acting on check valve 129 is provided, said actuator projecting from the piston head 105 into the cylinder chamber and being operated by the piston head 105 of the cylinder unit arranged in said cylinder chamber.

In the embodiment shown in FIG. 9, two separate transfer ports 106, 127 are provided, transfer port 106 according to FIG. 8 being provided for the purpose of extending the cylinder units I, II, whereas the other transfer port, 127 serves to retract said cylinder units I, II. It is, theoretically, just as well possible to provide an arrangement in which the actuator 126 acts directly on the non-return valve 124 of the first transfer port 106 so that only one single transfer port 106 will be required, this possibility being not shown in the drawing.

The actuating element for the check valve 107 consists of an actuator ring 111, which is arranged in an annular groove 112 provided in the circumferential surfaces of cylinder units I, II and which is adapted to be axially displaced against the force of a spring 113 towards the outer end face of the piston head 105. The actuator ring 111 is actuated by an annular shoulder 114 projecting radially inwards, said annular shoulder 114 being provided at the free, open end of the cylinder units 0, I enclosing the piston head 105. The actuator ring 111 has a collar 115 which is located on the actuator ring side facing the annular shoulder 114 and the radially outer circumferential surface of which is guided on the inner wall of the enclosing cylinder units 0, I. The end face of the collar 115 defines a stop means for said annular shoulder 114.

In the present embodiment, the closure member 71 of the check valve 107 has a spherical shape and is located in a valve chamber in which said closure member 71 is held at the valve-closing position by means of a spring 72. For the purpose of actuation, said closure member 71 is provided with a tappet 116 which projects axially towards the actuator ring 111 and by means of which the closure member 71 is raised from the valve seat as soon as the collar 115 of the actuator ring 111 strikes against the annular shoulder 114.

The locking ring 108 of the embodiment according to FIG. 8 has in the circumferential surface thereof an annular groove 117 whose groove wall 118, which faces the piston head, defines a ramplike sliding aid for the locking element 110. A particularly simple embodiment of said locking element 110 is a ball which is arranged in a hole provided in the wall of the cylinder units I, II. The free, open ends of the cylinder units 0, I, II each have provided therein a recess 119 or an annular groove permitting the locking element 110 to enter, whereby mutual mechanical blocking of the two abutting cylinder units 0, I, II is achieved.

When, in the fully retracted condition of the hydraulic cylinder, hydraulic fluid is fed through the opening 104, this will first of all have the effect that the first displaceable cylinder unit I will be extended, since the check valve 107 arranged in the piston head 105 of this cylinder unit I is first closed. As soon as the first telescopic cylinder unit I has fully been extended, the actuator ring 111 will strike against the annular shoulder 114, whereby the check valve 107 will be opened. The hydraulic fluid can thus flow into the next cylinder chamber, but only into said next cylinder chamber, since all the subsequent check valves 107 are still closed in an adequate manner. In this way, all cylinder units I, II are subsequently extended in a sequence in which the cross-sections decrease, and they are locked at the respective extended position.

Due to the fact that the individual cylinder units 0, I, II are mutually locked, the reverse sequence of steps is guaranteed when the hydraulic cylinder is retracted. For retracting the telescopic arrangement, the working load attached thereto can be utilized. In view of the fact that such a working load does not always exist, or rather that its size is frequently insufficient, a restoring cable 120 is connected to the cylinder unit II constituting the last cylinder unit in the direction of extension or to the piston which is displaceably guided in said last cylinder unit; said restoring cable 120 is adapted to be wound onto a winch 121. It will be expedient to drive this winch 121 by means of a hydraulic motor 122; this hydraulic motor 122 can be fed by the hydraulic means 123 which is required for actuating the hydraulic cylinder anyhow. The driving speed of the hydraulic means is controlled in a quantity- and/or pressure-dependent manner by the hydraulic medium discharged from the cylinder units 0, I, II, said control being effected via a valve, in particular a lowering braking valve.

The winch 121 is additionally acted upon by a cable tensioning means, especially by a spring motor 128, maintaining the restoring cable in a tensioned condition even if the hydraulic motor 122 has been switched off. This guarantees that the restoring cable 120 will always be held in a tensioned condition so that it will also be prevented from touching the delicate cylinder wall surfaces. This is important especially with regard to the fact that a slight retraction movement of the individual hydraulic cylinder units 0, I, II due to cooling down of the hydraulic medium cannot be excluded.

I claim:

1. A telescopic boom having boom members and cylinders units, comprising:

(a) a non-displaceable boom member;

(b) at least one displaceable boom member, connected to said non-displaceable boom member and telescopically displaceable with respect to the non-displaceable boom member;

(c) a non-displaceable cylinder unit, connected to the non-displaceable boom member and housed within the non-displaceable boom member;

(d) at least one displaceable cylinder unit connected to said non-displaceable cylinder unit and telescopically-displaceable with respect to said non-displaceable cylinder unit, said at least one displaceable cylinder unit being connected to said at least one displaceable boom member for telescopically displacing the at least one displaceable boom member with respect to the non-displaceable boom member, the at least one displaceable cylinder unit having a fully extended position, a fully retracted position, and a piston head for hydraulically separating the at least one displaceable cylinder unit from the non-displaceable cylinder unit, the piston head being located at an end face of said at least one displaceable cylinder unit, the piston head having a first transfer port for allowing fluid flow through the piston head between the non-displaceable cylinder unit and the at least one displaceable cylinder unit, a first check valve connected to the first transfer port for restricting fluid flow through the transfer port, and a first actuating element connected to the first check valve for opening the check valve when the at least one displaceable cylinder unit is in the fully extended position;

(e) a supporting device having a first component attached to at least one of the at least one displaceable cylinder unit and the non-displaceable cylinder unit, and having a second component attached to at least one of the at least one displaceable boom member and the non-displaceable boom member, the second component supporting the first component so that the boom members support the cylinder units; and (f) a locking means connected to the at least one displaceable cylinder unit for releasably locking the at least one displaceable cylinder unit in the fully extended position.

2. The telescopic boom of claim 1 wherein the first component of the supporting device comprises a first claw and a second claw and wherein the second component of the supporting device comprises a first rail and a second rail, the first claw enclosing the first rail and the second claw enclosing the second rail.

3. The telescopic boom of claim 2 comprising at least two displaceable boom members including at least one intermediate displaceable boom member and a distal displaceable boom member, wherein there is more than one said supporting device so that each boom member has a corresponding supporting device connected thereto, wherein said first component is attached to a corresponding cylinder unit and said second component is attached to a corresponding boom member, and wherein said at least two displaceable boom member are inner boom members telescopically-receivable within said non-displaceable boom member, said first and second rails of each of the at least two displaceable boom members including an inner first rail and an inner second rail, respectively, said distal displaceable boom member having an inner first rail extending the length of the distal displaceable boom member and an inner second rail extending the length of the distal displaceable boom member.

4. The telescopic boom of claim 3 wherein each said first claw engages a corresponding inner first rail and each said second claw engages a corresponding inner second rail when the telescopic boom is fully retracted.

5. The telescopic boom of claim 3 comprising a plurality of intermediate displaceable boom members, wherein the first rail and the second rail of each supporting device of each intermediate displaceable boom member are shorter than the corresponding boom member in which said rails are connected.

6. The telescopic boom of claim 3 wherein all first rails extend in planar alignment with each other and wherein all second rails extend in planar alignment with each other.

7. The telescopic boom of claim 1 wherein the at least one displaceable cylinder unit is connected to at least one displaceable boom member so that the at least one displaceable boom member moves simultaneously with the at least one displaceable cylinder unit.

8. The telescopic boom of claim 6 wherein each displaceable cylinder unit is connected to a corresponding displaceable boom member so that each displaceable boom member moves simultaneously with a corresponding displaceable cylinder unit.

9. The telescopic boom of claim 7 wherein the at least one displaceable cylinder unit is connected to the at least one displaceable boom member by tie rods.

10. The telescopic boom of claim 8 wherein each displaceable cylinder unit is connected to a corresponding displaceable boom member by tie rods.

11. A telescopic boom having boom members and cylinder units, comprising:

(a) a non-displaceable boom member;

(b) a plurality of displaceable boom members, connected to said non-displaceable boom member and telescopically-displaceable with respect to the non-displaceable boom member, said plurality of displaceable boom members including at least one intermediate displaceable boom member and distal displaceable boom member;

(c) a non-displaceable cylinder unit, connected to the non-displaceable boom member and housed within the non-displaceable boom member;

(d) a plurality of telescopically-displaceable cylinder units connected to corresponding displaceable boom members of said plurality of said displaceable boom members, including at least one intermediate displaceable cylinder and a distal displaceable cylinder unit, the at least one intermediate displaceable cylinder unit comprising a first displaceable cylinder unit connected to said non-displaceable cylinder unit and telescopically-displaceable with respect to said non-displaceable cylinder unit, said first displaceable cylinder unit being connected to said at least one intermediate displaceable boom member for telescopically displacing the at least one intermediate displaceable boom member with respect to the non-displaceable boom member, the first displaceable cylinder unit having a fully extended position, a fully retracted position, and a piston head for hydraulically separating the first displaceable cylinder unit from the non-displaceable cylinder unit, the piston head being located at an end face of said first displaceable cylinder unit, the piston head having a first transfer port for allowing fluid flow through the piston head between the non-displaceable cylinder unit and the first displaceable cylinder unit, a first check valve connected to the first transfer port for restricting fluid flow through the first transfer port, a first non-return valve cooperating with the first check valve for allowing fluid flow through the first transfer port in one direction only, a first actuating element connected to the first check valve for opening the first check valve when the first diplaceable cylinder unit is in the fully extended position, a second transfer port for allowing fluid flow through the piston head between the non-displaceable cylinder unit and the first displaceable cylinder unit, a second check valve connected to the second transfer port for restricting fluid flow through the second transfer port, a second non-return valve cooperating with the second check valve for allowing fluid flow through the second transfer port in one direction only, a second actuating element connected to the second check valve for opening the second check valve when a second displaceable cylinder unit of said plurality is in a fully retracted position, said second displaceable cylinder unit being connected to said first displaceable cylinder unit and telescopically-displaceable with respect to said first displaceable cylinder unit;

(e) closeable recirculating line means connected to the distal displaceable cylinder unit for allowing hydraulic fluid flow out of each said cylinder unit through each respective second transfer port; and (f) a supporting device having a first component attached to at least one of the first displaceable cylinder unit and the non-displaceable cylinder unit, and having a second component attached to at least one of the at least one intermediate displaceable boom member and the non-displaceable boom, the second component supporting the first component so that the boom members support the cylinder units.

12. The telescopic boom of claim 1 wherein said at least one displaceable cylinder unit comprises an annular shoulder for engaging a corresponding first actuating element, and wherein said corresponding first actuating element comprises an actuator ring for engaging the corresponding annular shoulder, a rod for connecting the corresponding actuator ring to the corresponding first check valve, and a spring for biasing the corresponding actuator ring so that the corresponding first check valve is closed.

13. The telescopic boom of claim 11 wherein each of said displaceable cylinder units further comprise an annular shoulder for engaging a corresponding first actuating element, and wherein said corresponding first actuating element comprises an actuator ring for engaging the corresponding annular shoulder, a rod for connecting the corresponding actuator ring to the corresponding first check valve, and a spring for biasing the corresponding actuator ring so that the corresponding first check valve is closed.

14. The telescopic boom of claim 1 further comprising a restoring cable connected to said at least one displaceable cylinder unit for retracting the telescopic boom and a winch connected to said restoring cable for retracting the restoring cable.

15. The telescopic boom of claim 11 further comprising a restoring cable connected to said distal displaceable cylinder unit for retracting the telescopic boom and a winch connected to said restoring cable for retracting the restoring cable.

16. The telescopic boom of claim 14 wherein the winch is driven by a hydraulic motor which is connected to a lowering braking valve for controlling a driving speed of the winch.

17. The telescopic boom of claim 15 wherein the winch is driven by a hydraulic motor which is connected to a lowering braking valve for controlling a driving speed of the winch.

18. The telescopic boom of claim 16 wherein the winch is connected to a biasing spring so that the restoring cable is constantly tensioned.

19. The telescopic boom of claim 17 wherein the winch is connected to a biasing spring so that the restoring cable is constantly tensioned.

20. The telescopic boom of claim 11 wherein the first component of the supporting device comprises a first claw and a second claw and wherein the second component of the supporting device comprises a first rail and a second rail, the first claw enclosing the first rail and the second claw enclosing the second rail.

21. The telescopic boom of claim 20 comprising at least two displaceable boom members including at least one intermediate displaceable boom member and a distal displaceable boom member, wherein there is more that one said supporting device so that each boom member has a corresponding supporting device connected thereto, wherein said first component is attached to a corresponding cylinder unit and said second component is attached to a corresponding boom member, and wherein said at least two displaceable boom members are inner boom members telescopically-receivable within said non-displaceable boom member said first and second rails of each of the at least two displaceable boom members including an inner first rail and an inner second rail, respectively, said distal displaceable boom member and an inner first rail extending the length of the distal displaceable boom member and an inner second rail extending the length of the distal displaceable boom member.

* * * * *